US005622368A

United States Patent [19]

Chang

[11] Patent Number: 5,622,368

[45] Date of Patent: Apr. 22, 1997

[54] PUZZLE DISC

[76] Inventor: Chiu-Huang Chang, P. O. Box 82-144, Taipei, Taiwan

[21] Appl. No.: 600,734

[22] Filed: Feb. 13, 1996

[51] Int. Cl.[6] ..... A63F 9/08

[52] U.S. Cl. ..... 273/153 S

[58] Field of Search ..... 273/153 R, 153 S, 273/155, 157 R

[56] References Cited

U.S. PATENT DOCUMENTS

| | | | |
|---|---|---|---|
| 448,019 | 3/1891 | Garben | 273/153 S |
| 564,022 | 7/1896 | Murphy | 273/153 S |
| 908,410 | 12/1908 | Jensen | 273/153 S |
| 1,132,430 | 3/1915 | Brogan et al. | 273/153 S |
| 3,148,884 | 9/1964 | Steinhardt | 273/153 S |
| 3,946,514 | 3/1976 | Joslyn | 273/153 S |
| 4,871,173 | 10/1989 | Lammertink | 273/153 S |

*Primary Examiner*—Steven B. Wong
*Attorney, Agent, or Firm*—Alfred Lei

[57] ABSTRACT

A puzzle disc including a body portion, a cover having two open slots extending inwardly from its circumference and fitted in a central portion of the body portion thereby forming a track having a neck portion between the cover and the body portion, a circular member rotatably arranged in the body portion, and a plurality of movable elements fitted in the track, whereby the degree of difficulty in playing the puzzle disc can be adjusted to fit for players with different intelligence.

1 Claim, 8 Drawing Sheets

PUZZLE DISC

BACKGROUND OF THE INVENTION

1. Field of the Invention

This invention relates to an improved puzzle disc.

2. Description of the Prior Art

It has been found that the conventional puzzle disc (see FIG. 1) includes a body portion 1 in which are fitted a cover 12 and a circular member 13 having a passage 131. Between the body portion 1 and cover 12 there is a track 14 in communication with the passage 131 of the circular member 13. A plurality of movable elements 15 are fitted into the track 14. The sequence of the movable elements 15 can be changed by the circular member 13 and the track 14. However, the degree of difficulty in playing such a puzzle disc cannot be adjusted to fit for players with different intelligence.

Therefore, it is an object of the present invention to provide a puzzle disc which can obviate and mitigate the above-mentioned drawbacks.

SUMMARY OF THE INVENTION

This invention relates to an improved puzzle disc.

It is the primary object of the present invention to provide a puzzle disc which is adjustable in the degree of difficulty in playing.

It is another object of the present invention to provide a puzzle disc which is interesting and can cause much fun in playing.

It is still another object of the present invention to provide a puzzle disc which is simple in construction.

It is still another object of the present invention to provide a puzzle disc which is low in cost.

It is a further object of the present invention to provide a puzzle disc which is facile to manufacture.

Other objects of the invention will in part be obvious and in part hereinafter pointed out.

The invention accordingly consists of features of constructions and method, combination of elements, arrangement of parts and steps of the method which will be exemplified in the constructions and method hereinafter disclosed, the scope of the application of which will be indicated in the claims following.

DETAILED DESCRIPTION OF THE PREFERRED EMBODIMENT

Figure 1:
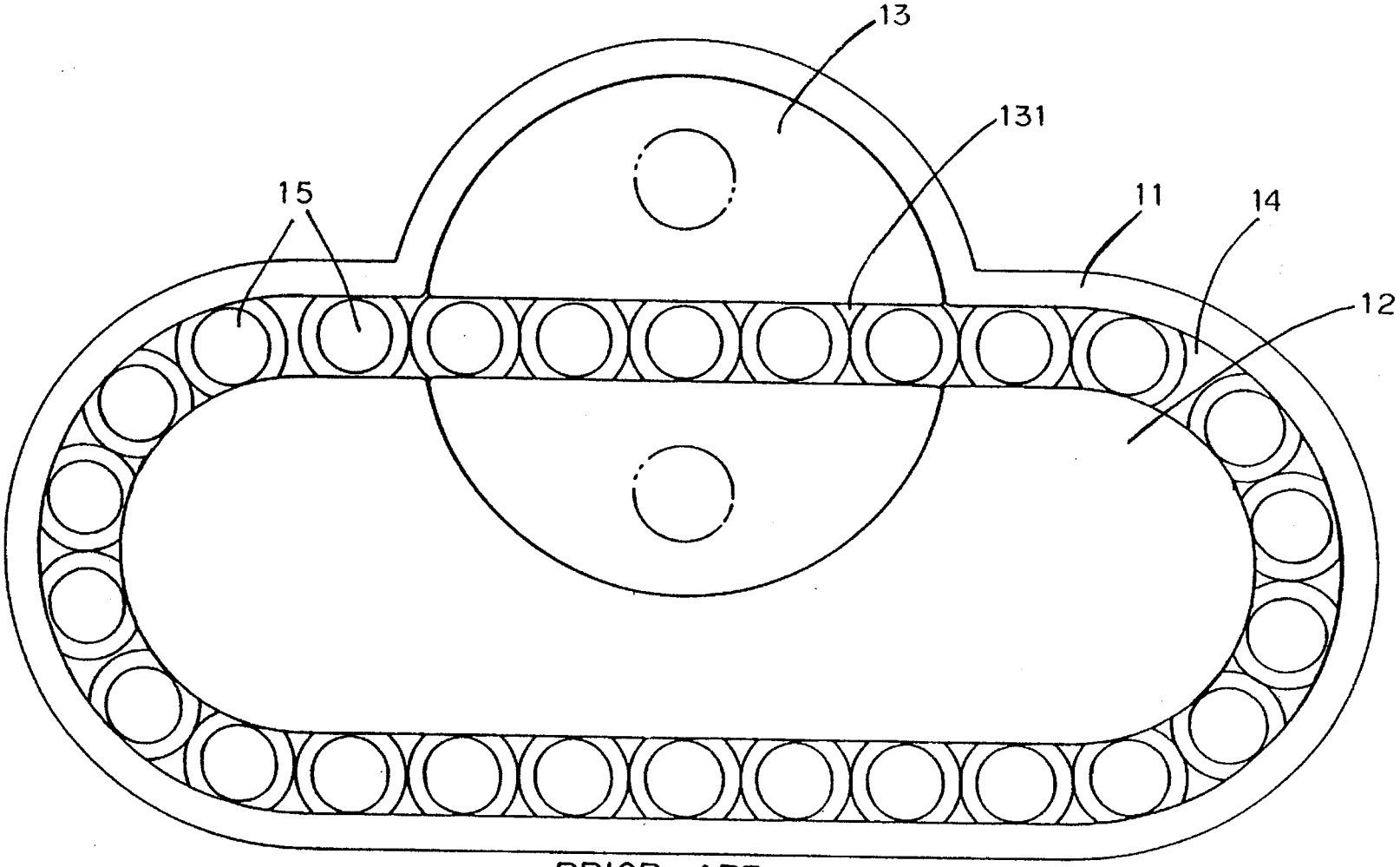
PRIOR ART FIG. 1
FIG. 1 is a top view of a prior art puzzle disc.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alternations and further modifications in the illustrated device, and such further applications of the principles of the invention as illustrated herein being contemplated as would normally occur to one skilled in the art to which the invention relates.

Figure 2:
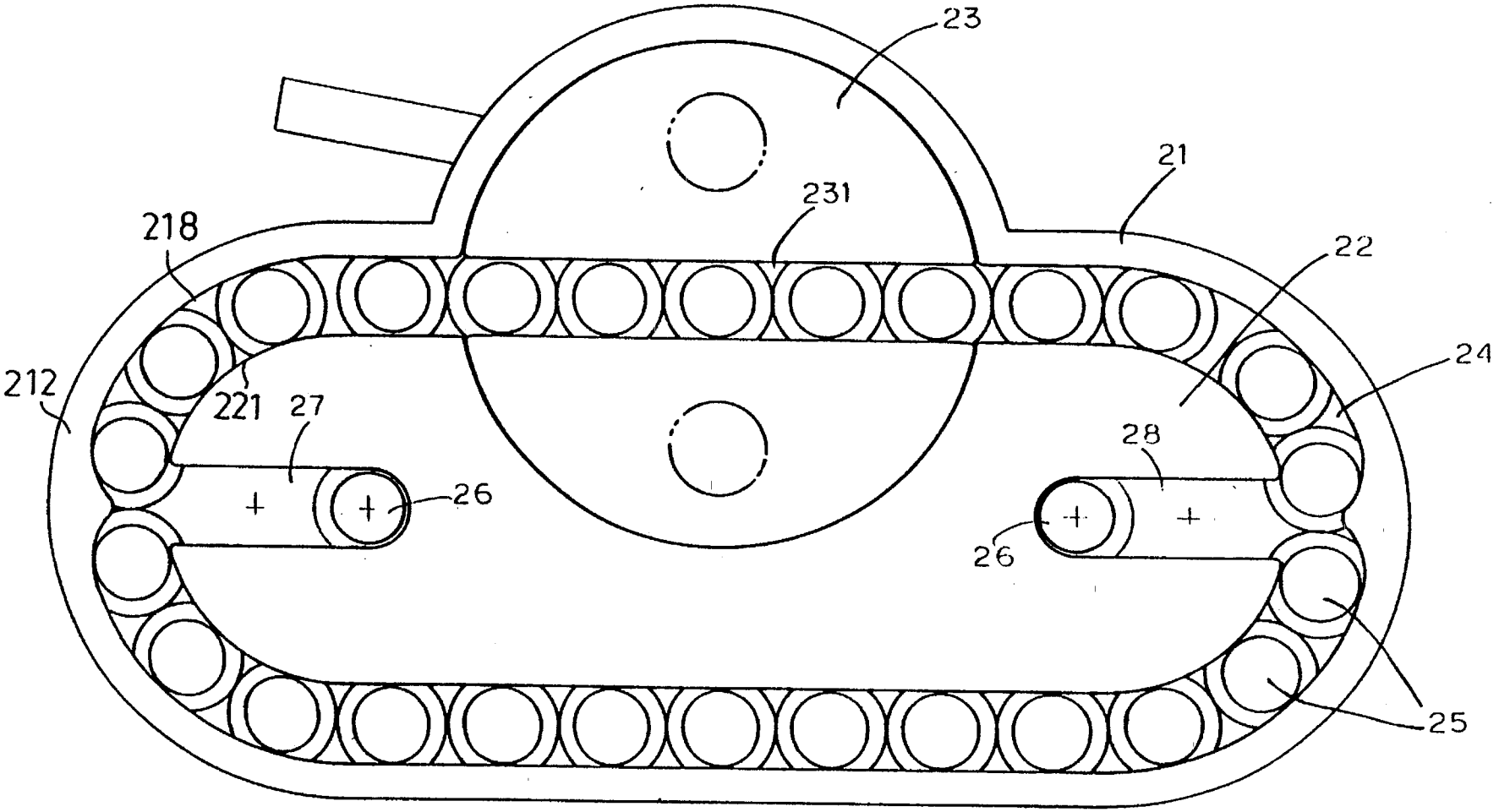
FIG. 2 is a top view of the present invention.
Figure 3:
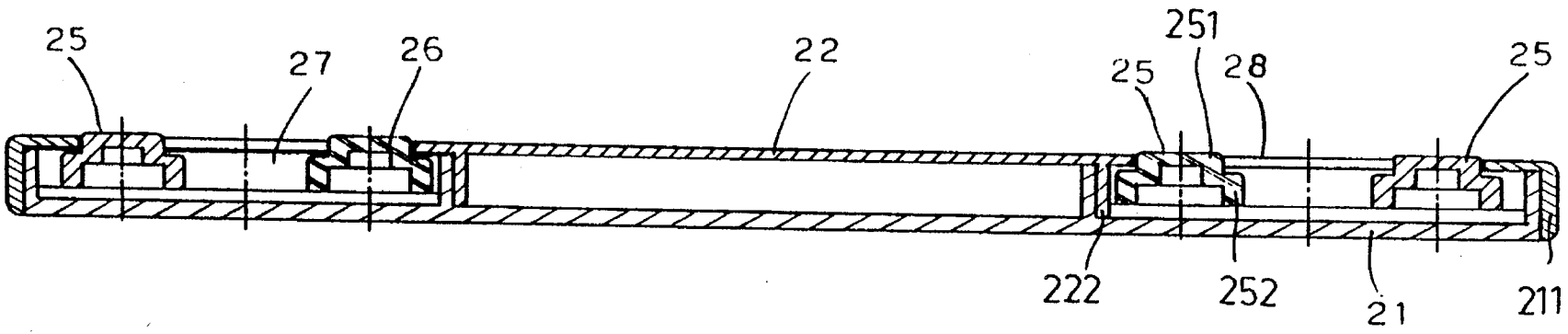
FIG. 3 is a sectional view of the present invention.

With reference to the drawings and in particular to FIGS. 2 and 3, the puzzle disc according to the present invention mainly comprises a body portion 21, a cover 22, a circular member 23, and a plurality of movable elements 25. The body portion 21 has a vertical wall 211 around its circumference and a flange 212 extending inwardly from the upper edge of the vertical wall 211. The cover 22 has a leg 222 depending dowardly from its circumference, a flange 221 extending outwardly from the upper edge of the leg 222, and two open slots 27 and 28. The cover 22 is fitted in the central part of the body portion 21 thereby forming a track 24 having a neck portion 218 between the cover 22 and the body portion 21. The slot 27 has the same width as the neck portion 218 of the track 24. The circular member 23 has a passage 231 across its diameter which has the same cross section as the track 24. The circular member 23 is arranged in the body portion 21 so that the circular member 23 can be rotated to align its passage 231 with the track 24 of the body portion 21. The movable element 25 is a cylindrical member with an upper end 251 and a lower end. The upper end 251 of the moveable element 25 is smaller than and concentric with the lower end of the moveable element 25. The diameter of the lower portion 252 of the movable element 25 is larger than the width of the neck portion 218 of the track 24, but the diameter of the upper end 251 of the movable element 25 is slightly less than the width of the neck portion 218 of the track 24, so that the movable element 25 can be prevented from disengaging from the track 24 and can be moved freely along the track 24.

Figure 4:
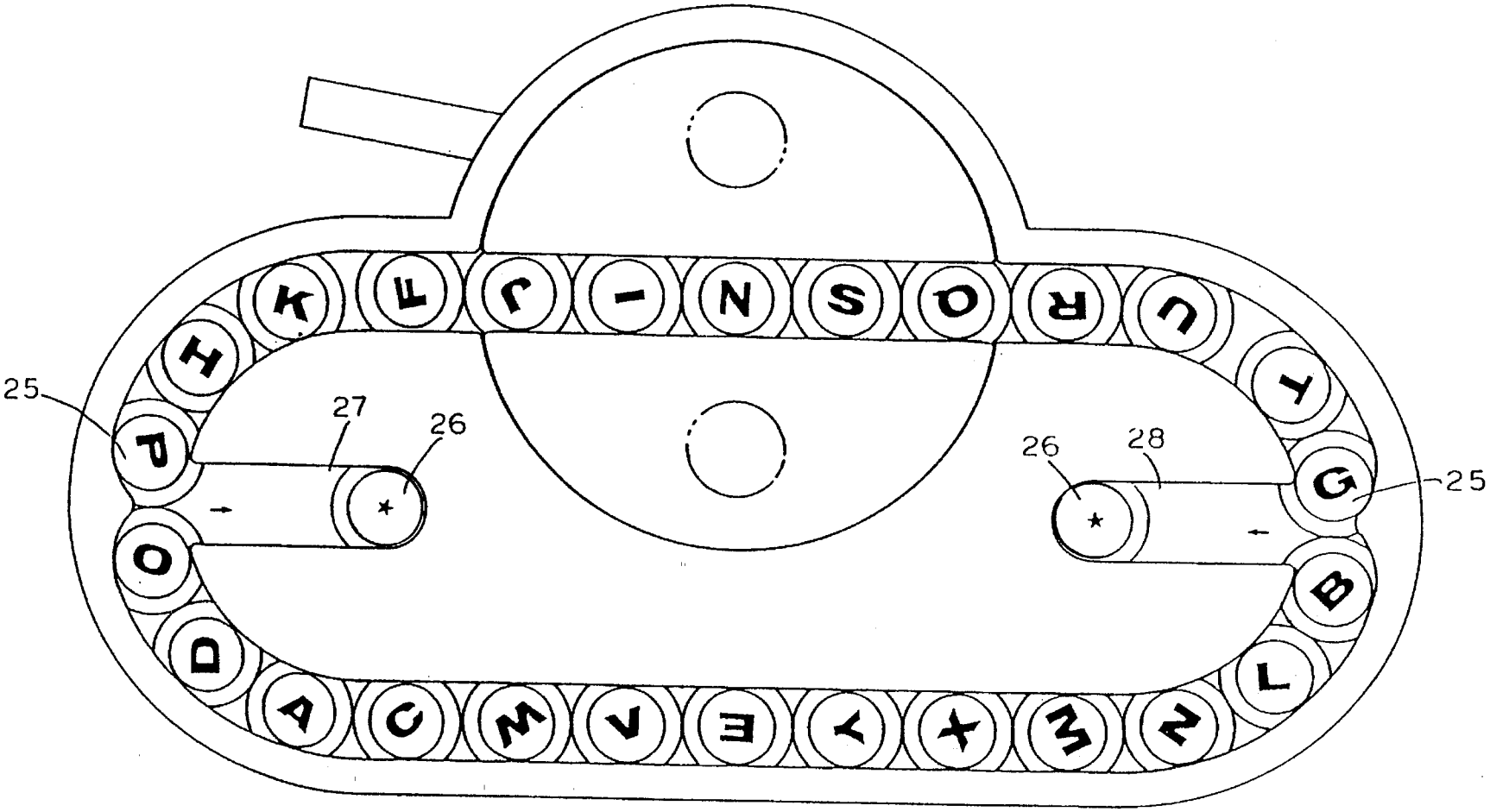
FIG. 4 illustrates a first method of playing the present invention.

There are four methods of playing the puzzle disc according to the present invention, which will be described hereinafter in detail:

1. Referring to FIG. 4, the two adjusting movable elements 26 are moved into the two open slots 27 and 28 so that two movable elements 25 may be moved into the open slots 27 and 28.

Figure 5:
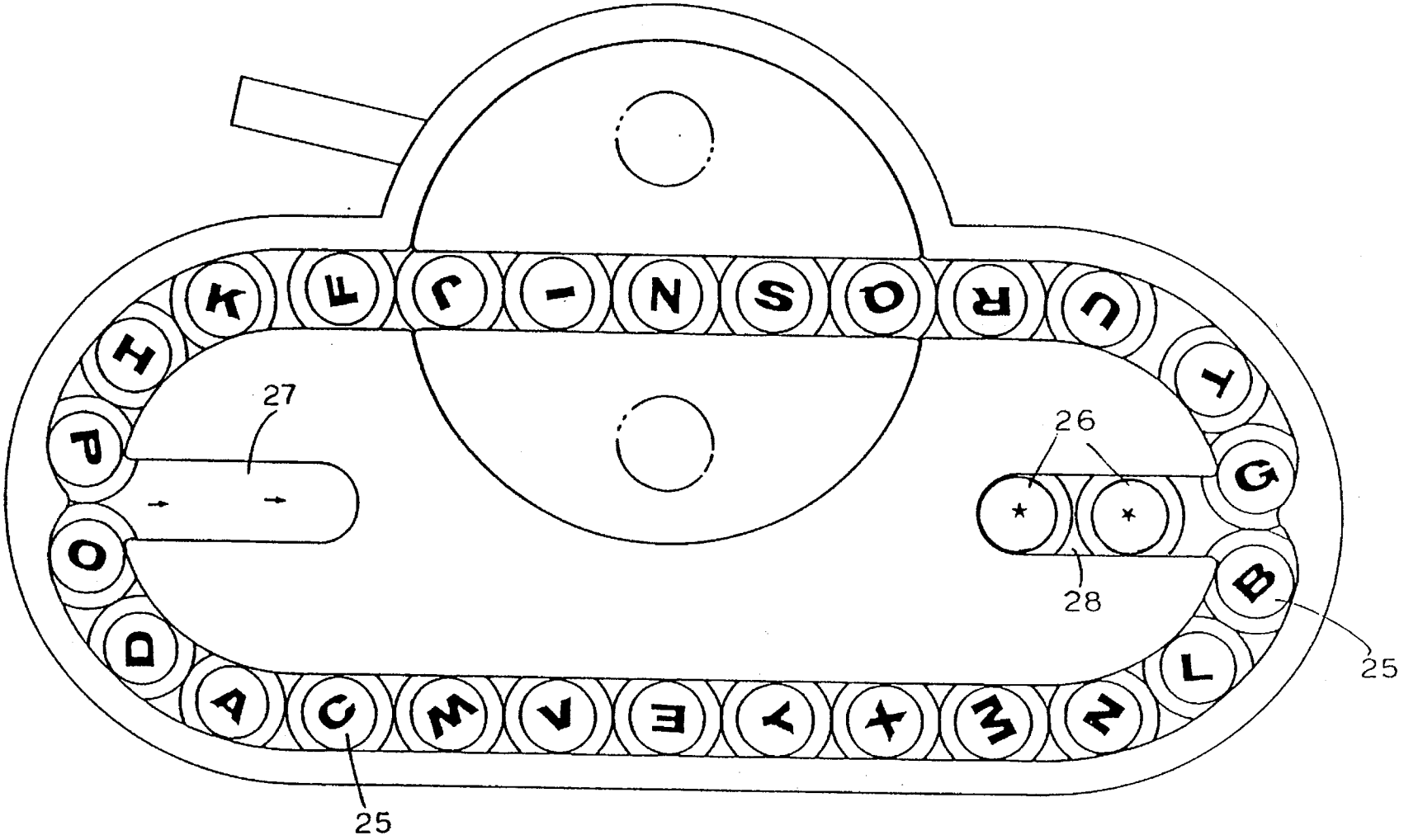
FIG. 5 illustrates a second method of playing the present invention.

2. Referring to FIG. 5, the two adjusting movable elements 26 are moved into the open slot 28 so that two movable elements 25 may be moved into the other open slot 27.

Figure 6:
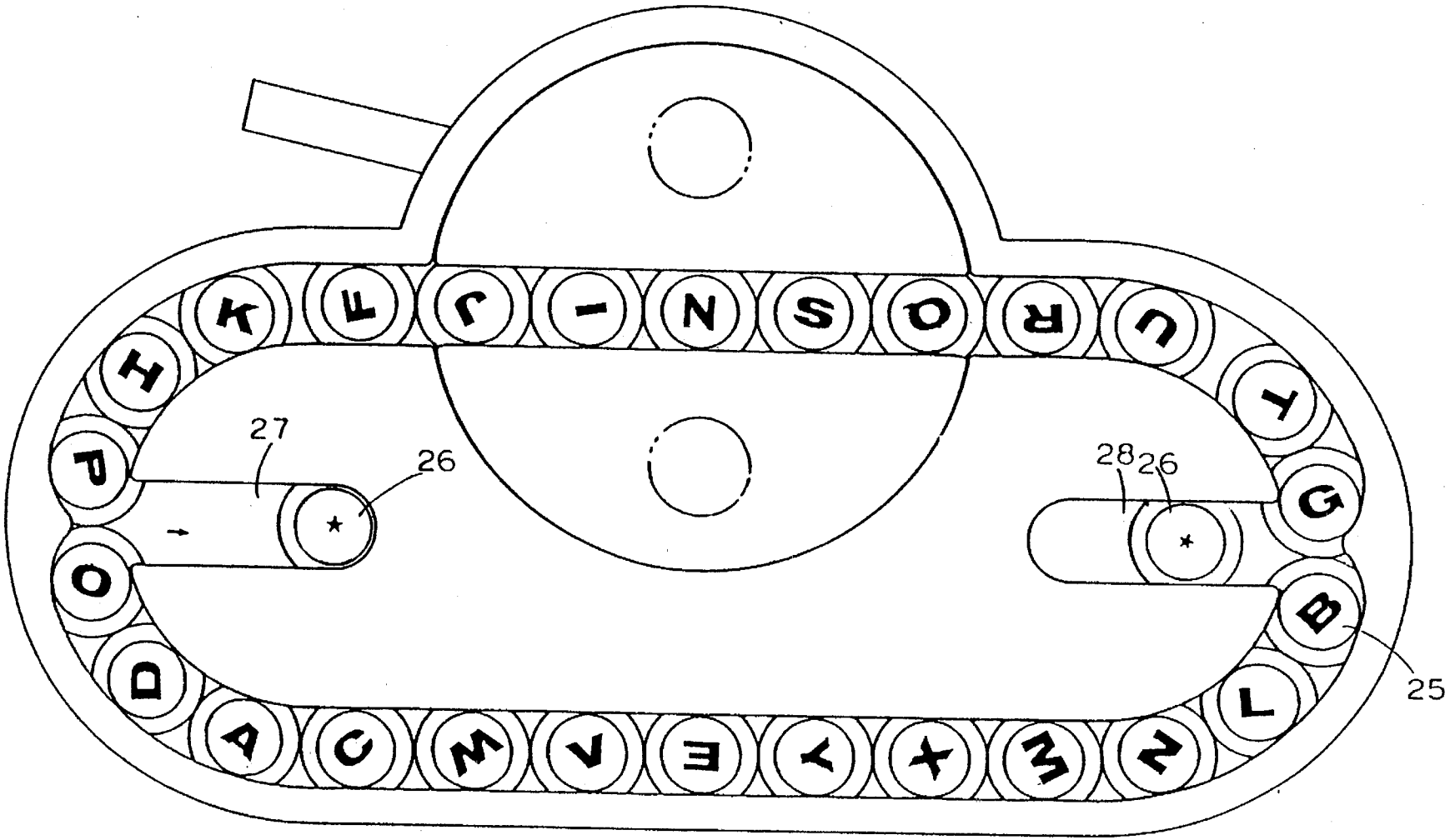
FIG. 6 illustrates a third method of playing the present invention.

3. Referring to FIG. 6, an adjusting movable element 26 is moved into the outer position of the open slot 28 while another adjusting movable element 26 is moved into the inner position of another open slot 27 so that only a movable element 25 can be moved into the open slot 27.

Figure 7:
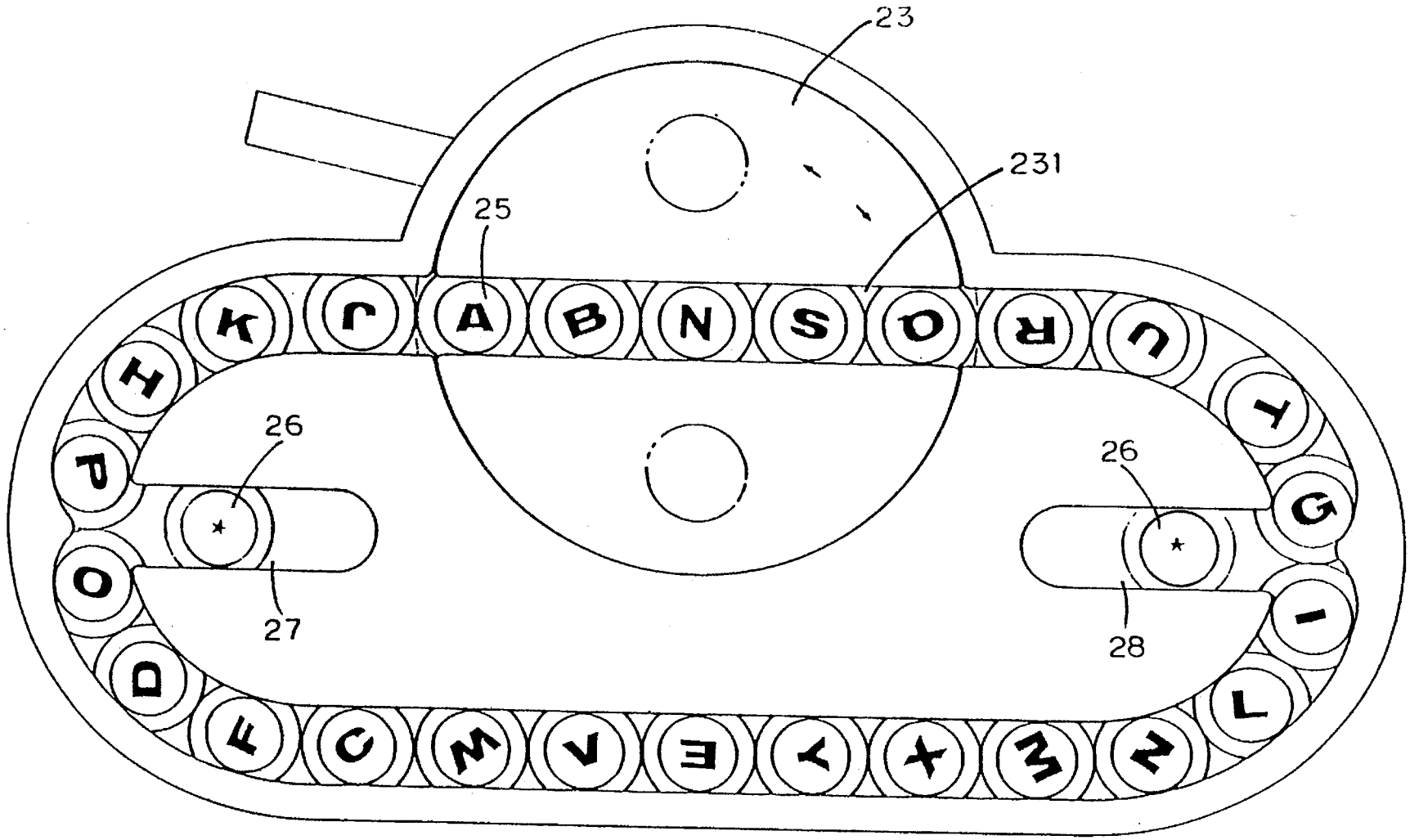
FIGS. 7 and 8 illustrate a fourth method of playing the present invention.
Figure 8:
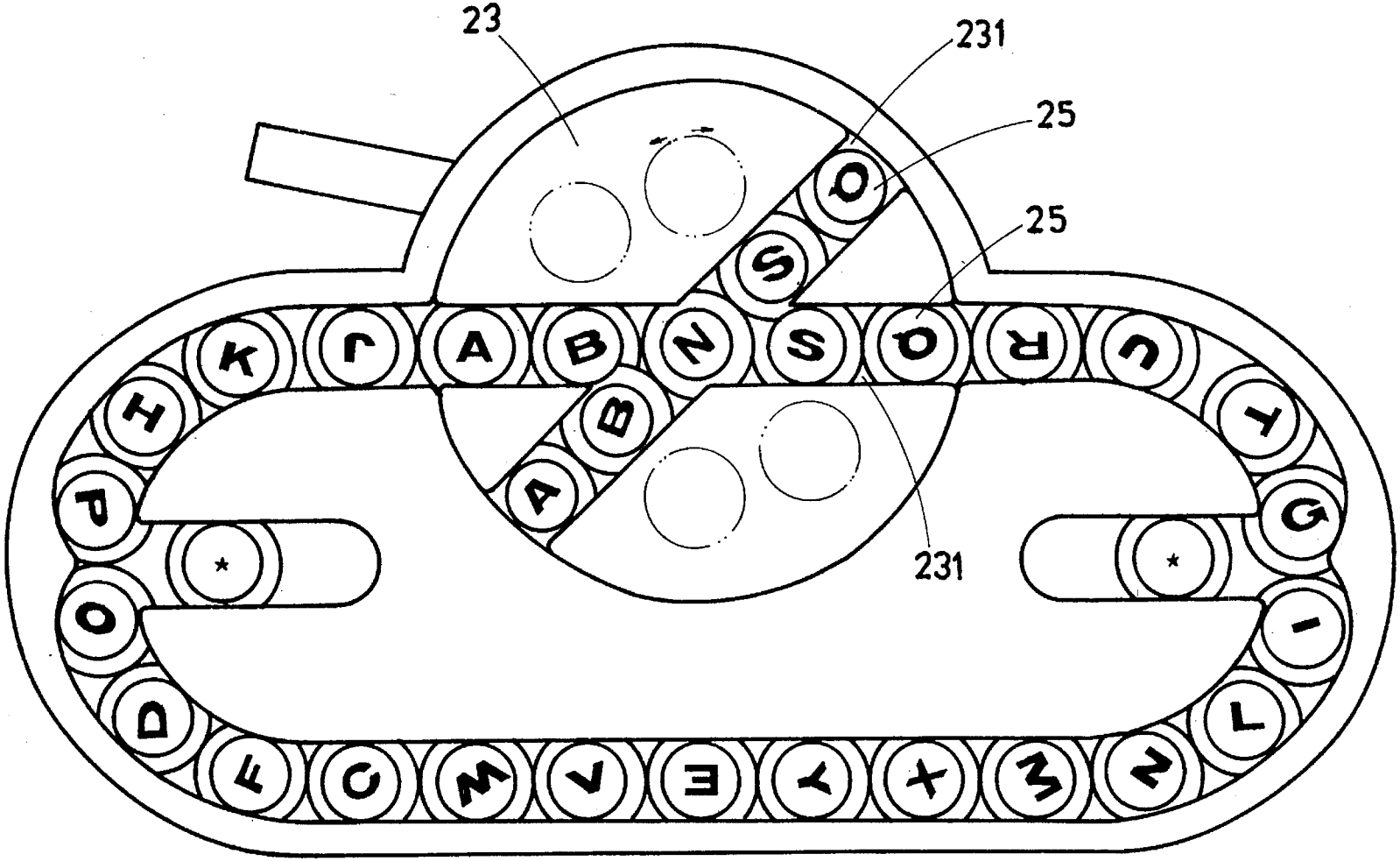

4. Referring to FIGS. 7 and 8, the two adjusting movable elements 26 are moved into the outer positions of the open slots 27 and 28, respectively. Then, the circular member 23 may be rotated to adjust the sequence of the movable elements 25.

The invention is naturally not limited in any sense to the particular features specified in the forgoing or to the details of the particular embodiment which has been chosen in order to illustrate the invention. Consideration can be given to all kinds of variants of the particular embodiment which has been described by way of example and of its constituent elements without thereby departing from the scope of the invention. This invention accordingly includes all the means constituting technical equivalents of the means described as well as their combinations.

I claim:

1. A puzzle disc comprising:

a body portion having a vertical wall around a circumference thereof and a flange extending inwardly from an upper edge of said vertical wall;

a cover having a leg depending downwardly from a circumference thereof and a flange extending outwardly from an upper edge of said leg, and two open slots extending inwardly from said circumference of said cover, said cover being fitted in a central portion of said body portion thereby forming a track having a neck portion between said cover and said body portion, said slots having same width as said neck portion;

a circular member rotatably arranged in said body portion and having a center aligned with a center line of said track, said circular member being formed with a passage across a diameter thereof; and a plurality of movable elements fitted in said track and being cylindrical in shape, said movable element having a lower portion with a diameter larger than said neck portion and an upper end concentric with said lower portion and having a diameter smaller than said lower portion and said neck portion.

* * * * *